US006431887B1

(12) United States Patent
Yeomans et al.

(10) Patent No.: US 6,431,887 B1
(45) Date of Patent: Aug. 13, 2002

(54) ELECTRICAL CONNECTOR ASSEMBLY WITH AN EMI SHIELDED PLUG AND GROUNDING LATCH MEMBER

(75) Inventors: Michael Anthony Yeomans, Camp Hill; Kevin E. Walker, Hershey, both of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/584,229

(22) Filed: May 31, 2000

(51) Int. Cl.[7] ..... H01R 4/66

(52) U.S. Cl. ..... 439/108; 439/352; 439/607; 439/906

(58) Field of Search ..... 439/108, 607, 439/696, 610, 352, 357, 358, 939, 906

(56) References Cited

U.S. PATENT DOCUMENTS 5,207,597 A * 5/1993 Kline et al. ..... 439/108
5,545,052 A 8/1996 Hirai
5,580,268 A * 12/1996 Miyazawa ..... 439/352
5,584,718 A 12/1996 Sukegawa
5,634,809 A * 6/1997 Hirai ..... 439/352
5,660,558 A 8/1997 Osanai et al.
5,766,027 A 6/1998 Fogg
5,879,194 A 3/1999 Thenaisie et al.
5,920,459 A 7/1999 Weber et al.

* cited by examiner

*Primary Examiner*—Tho D. Ta

(57) ABSTRACT

An electrical connector is provided having a conductive receptacle assembly with walls including grounding contacts, and a conductive plug member for connection to the receptacle assembly. The plug member includes peripheral surfaces that electrically engage grounding contacts on the receptacle assembly. A latch assembly is mounted to the plug member and includes a spring biasing face place that lockably engages one wall of the receptacle assembly. The latch assembly is conductive to afford a grounding correction between the plug member and receptacle assembly along one peripheral wall therebetween. The plug is formed with upper and lower shells, each of which is formed as a unitary structure, such as during a diecast molding procedure. The upper and lower shells are conductive and formed with substantially no openings therein to define a chamber therebetween offering significant EMI shielding characteristics. A PC equalization board is enclosed within the upper and lower shells. The PC equalization board is maintained in a fixed position and orientation by directly contacting shelves and keying protrusions formed integrally on the interior surfaces of the sides of one of the upper and lower shells.

10 Claims, 10 Drawing Sheets

Fig. 1
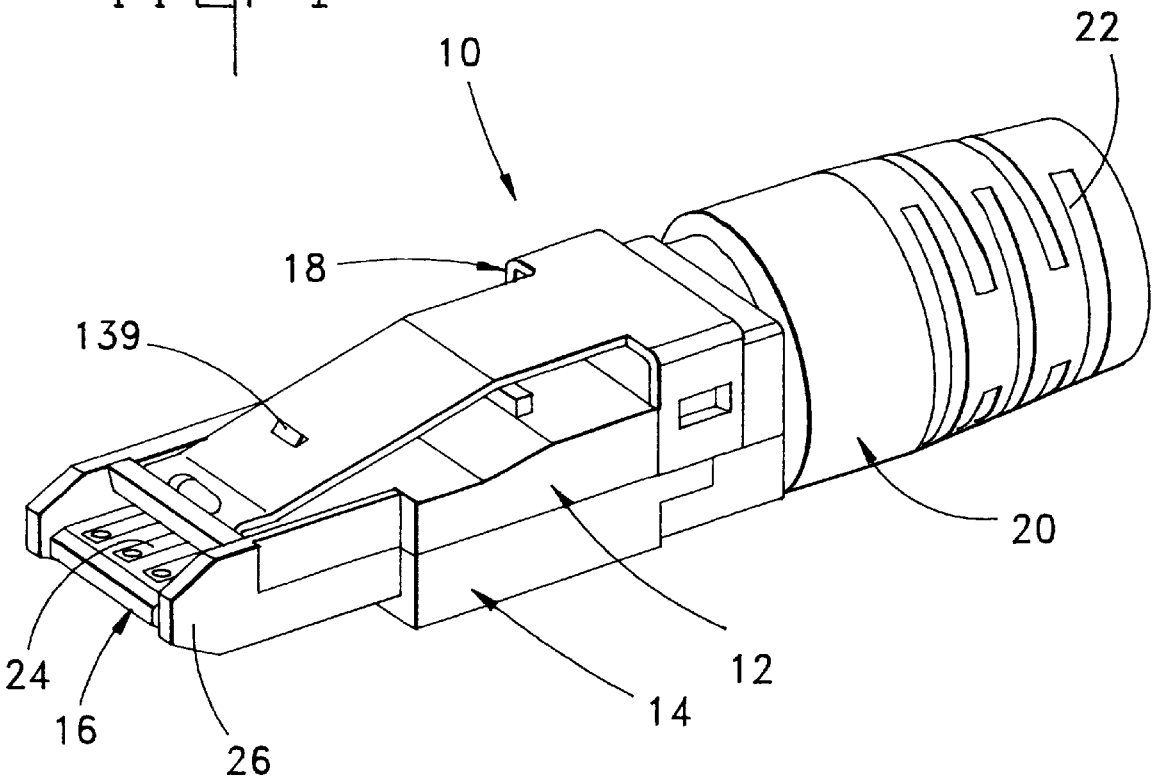
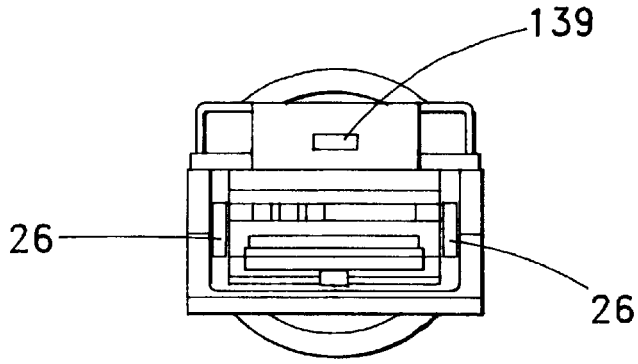
Fig. 1B 16
191
215
194
208
186
206
192
219
217
204
180
204
181
182
184
204
190
188
216
218
191
214

Fig. 10
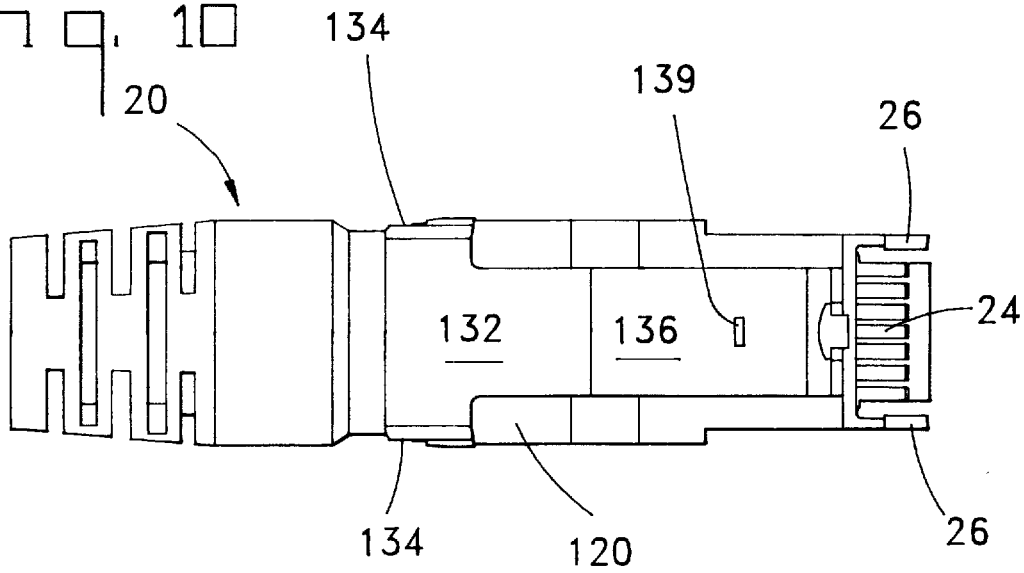
Fig. 11
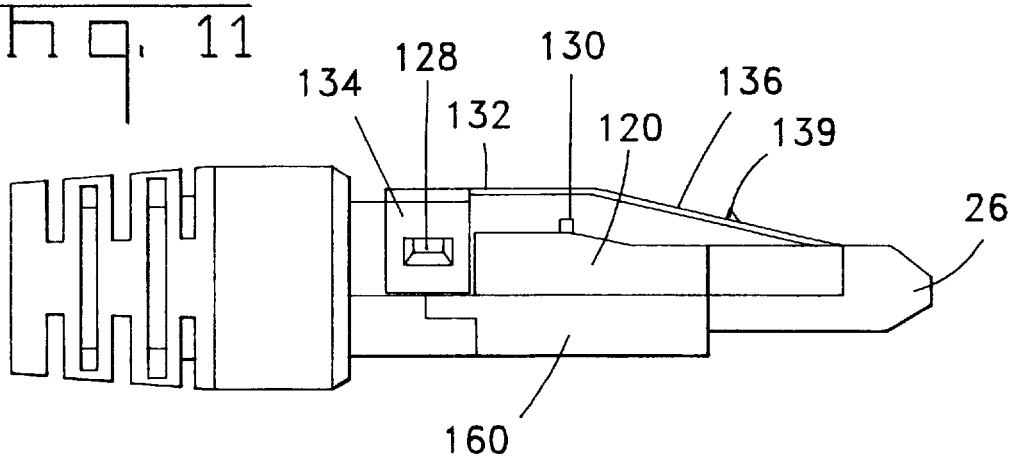
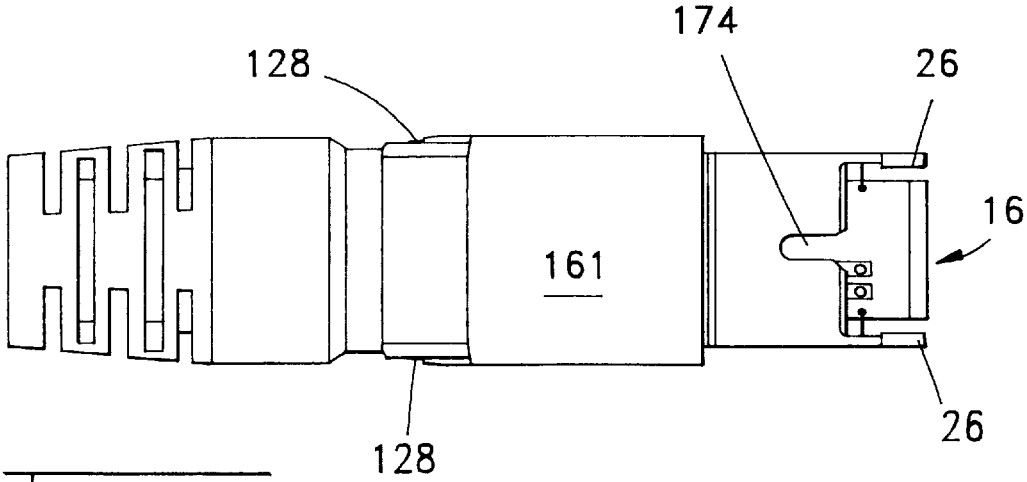
Fig. 12

ELECTRICAL CONNECTOR ASSEMBLY WITH AN EMI SHIELDED PLUG AND GROUNDING LATCH MEMBER

BACKGROUND OF THE INVENTION

The preferred embodiments of the present invention generally relate to electrical connectors for use with high speed serial data, and more particularly, to connector assemblies for transferring high speed serial data from a cable to a circuit board.

In the past, electrical cable assemblies have been proposed for connecting electrical cable to circuit boards. Conventional cable assemblies have been provided with an equalizer circuit board within the connector for performing signal conditioning. Performing signal conditioning within a circuit in the connector assembly, reduces the time required to incorporate signal conditioning circuit elements with a cable assembly and reduces the time required for connection of the circuit elements with the electrical contacts and the cable conductors. One example of a conventional cable assembly with an equalizer board is described in U.S. Pat. No. 5,766,027, commonly owned with the present application.

Conventional high speed serial data connectors (HSSDC) comprise a plug and receptacle combination interconnected through contact fingers. The plug receives an insulated holder that, in turn, receives an equalizer card. The equalizer card includes signal conditioning circuitry.

HSSDC connectors form a grounding plane surrounding the adjoining surfaces of the receptacle and plug in order to afford electromagnetic interference (EMI) shielding around the contact fingers forming the high speed serial data connection between the plug and receptacle. In conventional HSSDC connectors, the grounding plane has been maintained by locating a plurality of grounding beams on the top, bottom and side walls of the receptacle and engaging the top, bottom and side surfaces of the plug. Conventional grounding beams are J-shaped integral extensions of the walls and are bent to project forward, upward and into the opening of the receptacle. The J-shaped ground beams are biased inward to maintain an electrical connection with the plug once inserted.

However, J-shaped grounding beams take up an operation region inside the receptacle between the receptacle and plug walls. The region thickness substantially equals the radius of the J-shaped portion of the grounding beam. Consequently, the height and width of the opening in the receptacle must be greater than the height and width of the plug by an amount at least equal to the curved radius of the grounding beams. When grounding beams are located above, below and on either side of the plug, they undesirably increase the height and width of the receptacle. Certain applications for HSSDC connectors have significant space constraints.

In addition, the distance between the grounding beams should be maintained less than a predetermined maximum spacing. Otherwise, energy due to high speed signals radiates from the connection of the plug and receptacle. The spacing between grounding beams controls the frequency range at which signals may be carried through the connection. As the frequency of the transmitted signal increases, the maximum acceptable distance between the grounding beams decreases. The maximum distance is calculated between the two grounding beams that are furthest from one another (e.g., top to bottom, side to side, top to side or side to bottom). The connector assembly is preferably operable with frequencies having a wavelength range between six and twenty-four times greater than the largest distance between any two grounding beams.

The need for a large portion of the perimeter to be covered with grounding contacts is balanced with other design considerations, such as physical constraints, material cost, complexity and the forces needed to connect the plug and receptacle. As additional grounding beams or contacts are added, the plug becomes harder to insert into the receptacle since each contact presents a contact force to the plug that must be overcome to bend the contact open. A compromise is reached between the cost, complexity, physical size, forces needed to insert the plug and the EMI shielding characteristics of the connector.

Conventional HSSDC assemblies have used sheet metal to construct the plug and receptacle. Sheet metal is folded into a desired configuration. When protrusions, shelves and other features are desired to be added to the plug, holes must be punched through the sheet metal shell, or separate components must be fitted in the sheet metal to offer the features. Components, separate and apart from the metal shell, are also provided to latch the plug in the receptacle. It is undesirable to punch holes through the metal shell since the openings permit leakage of electromagnetic radiation. Conventional HSSDC connectors provide a plastic insert into the plug metal shell. The plastic insert includes the desired features for holding the PC equalizing board.

A need exists for an improved HSSDC connection assembly that simplifies the number of parts needed to construct the connector and reduces the physical dimensions of the connector without sacrificing electrical performance, latching performance or connection forces. It is an object of the preferred embodiments of the present invention to meet one or more of these needs and other objectives that will become apparent from the description and drawings set forth below.

BRIEF SUMMARY OF THE INVENTION

In accordance with at least one preferred embodiment of the present invention, an electrical connector is provided having a conductive receptacle assembly with walls defining a connector opening. At least one of the walls includes grounding contacts. The electrical connector further includes a conductive plug member for connection to the receptacle assembly through the connector opening. The plug member includes peripheral surfaces that are electrically engaged by the ground contacts on the walls of the receptacle assembly. A latch assembly is mounted to the plug member. The latch assembly includes a spring bias facing plate that lockably engages one of the side walls of the receptacle when the plug is inserted into the receptacle. The latch assembly is conductive and maintains a grounding connection between the plug member and a wall of the receptacle to which the latch is secured. The grounding contacts maintain grounding connections between the remaining walls of the receptacle and the walls of the plug member in order that the latch assembly and grounding contact form a grounding plane that surround the periphery of the plug.

In accordance with one embodiment, the latch assembly includes a principal body extending laterally to be formed integrally with side flanges. The principal body extends in a longitudinal direction to be formed integral with the facing plate. A locking projection is formed on the facing plate and arranged to align with and directly engage a hole in the receptacle assembly. The facing plate remains bias against the receptacle assembly to maintain the latch and grounding connections. The latch assembly further includes a leading section having a hole and lower lip portion directly engaging a knob and a U-shaped recess in a front face of the plug member. The leading section of the latch is sandwiched between a front face of the upper shell and a cross bar of the lower shell of the plug member when the shells are combined.

In one embodiment, the latch assembly is comprised of a T-shaped body integrally molded with side flanges, the facing plate and a leading edge. The side flanges and leading edge include holes that snapably engage knobs projecting from the exterior of the plug member. The holes and knobs secure the latch assembly to the plug member.

In another embodiment, the receptacle includes multiple J-shaped ground beams provided along at least one wall of the receptacle proximate the opening thereto through which the plug is received. The J-shaped grounding beams are formed integral with lead edges of the walls of the receptacle and extend forward, upward and into the receptacle opening to form grounding connections with the plug.

In yet another embodiment, an electrical connector is provided having a plug assembly matingly connected with a receptacle for carrying high speed serial data from a serial cable. The connector includes an upper shell having a top, sides, a back end and front face all formed integrally with one another. A lower shell is provided with a bottom, sides, a back end and a front face all formed integrally with one another. The upper and lower shells sealably join one another along mating edges of the sides, back ends and front faces to form an EMI shielded chamber therein. A PC equalization board having signal conditioning circuitry is enclosed within the upper and lower shells. The PC equalization board includes side edges having a contour that conforms to an interior contour of the side walls. The PC equalization board directly contacts and is supported by the interior surfaces of the side walls of the upper and lower shells to maintain the PC board in a desired horizontal and vertical orientation and relation to the plug. The mating edges of the sides, front face and back end of the lower shell include a skirt. Corresponding edges of the sides, front face and back end of the upper shell include a recess configured to mate with the skirt on the lower shell in order to provide an EMI shielded connection therebetween.

In one embodiment of the plug, the front face of the upper shell includes pens extending forward therefrom. The front face of the lower shell includes a cross bar connecting the sides thereof. The pins on the upper shell are inserted under the crossbar of the lower shell to retain the front faces of the upper and lower shells securely engaged with one another.

In another embodiment of the plug, the back ends of the upper and lower shells includes integral upper and lower tubular sections, respectively. When the upper and lower shells are combined, the upper and lower tubular sections mate with one another to form a circular opening to receive the cable. A ferrule is inserted over the upper and lower tubular sections and crimped thereon to secure the back ends of the shells to one another.

In another embodiment of the plug, the interior surfaces of the lower shell include integral protrusions defining shells directly support the PC equalization board in a desired vertical position and orientation. The interior surfaces of the lower shell also include integral protrusions defining keys that are received within recesses in either side of the PC board to maintain the PC board in a desired horizontal position and orientation with respect to the plug.

In yet another embodiment of the plug, the bottom of the shell is provided with a notch, while the receptacle is provided with a polarizing key. The notch and polarizing key are configured to align with one another only when the plug is properly oriented relative to the receptacle. The plug may not be inserted into the receptacle until the polarizing key is aligned with a notch, thereby preventing incorrect connection.

In one embodiment, the upper and lower shells are formed of diecast injection molded conductive material.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings embodiments which are presently preferred. It should be understood, however, that the present invention is not limited to the precise arrangements and instrumentality shown in the attached drawings.

FIG. 1 illustrates a perspective view of a plug formed in accordance with a preferred embodiment of the present invention.

FIG. 3 illustrates a perspective view of an insulated housing and contact fingers formed in accordance with a preferred embodiment of the present invention.

FIG. 10 illustrates a top plan view of a plug formed in accordance with a preferred embodiment of the present invention.

FIG. 11 illustrates a side plan view of a plug formed in accordance with a preferred embodiment the present invention.

FIG. 12 illustrates a bottom plan view of a plug formed in accordance with a preferred embodiment of the present invention.

FIG. 16 is a front plan view of a receptacle formed in accordance with a preferred embodiment of the present invention.

FIG. 17 is a perspective view of a receptacle formed in accordance with a preferred embodiment of the present invention.

FIG. 18 is a front plan view of a plug formed in accordance with a preferred embodiment of the present invention.

DETAILED DESCRIPTION OF THE INVENTION

Figure 2:
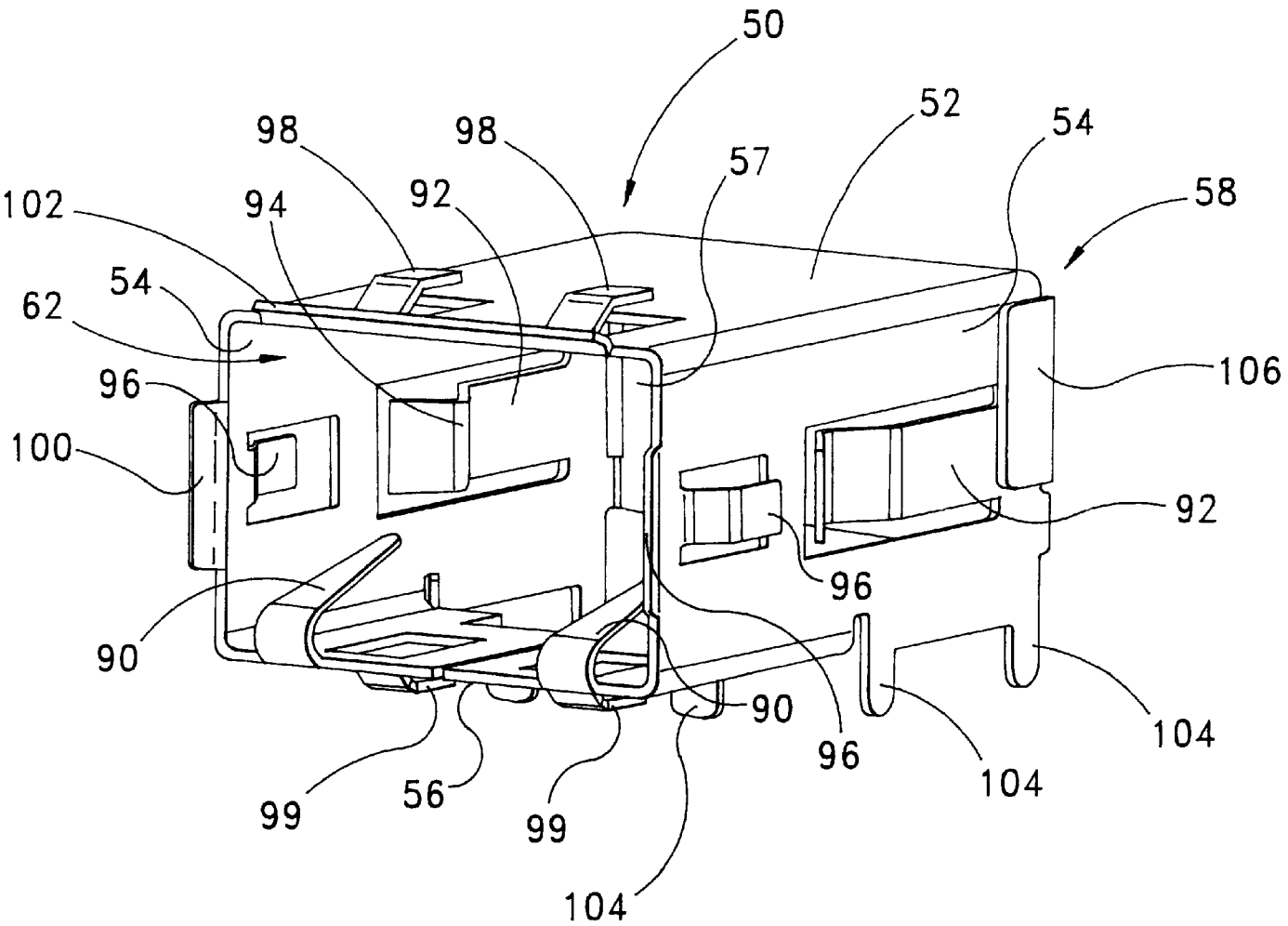
FIG. 2 illustrates a perspective view of a receptacle shell formed in accordance with a preferred embodiment of the present invention.
Figure 7:
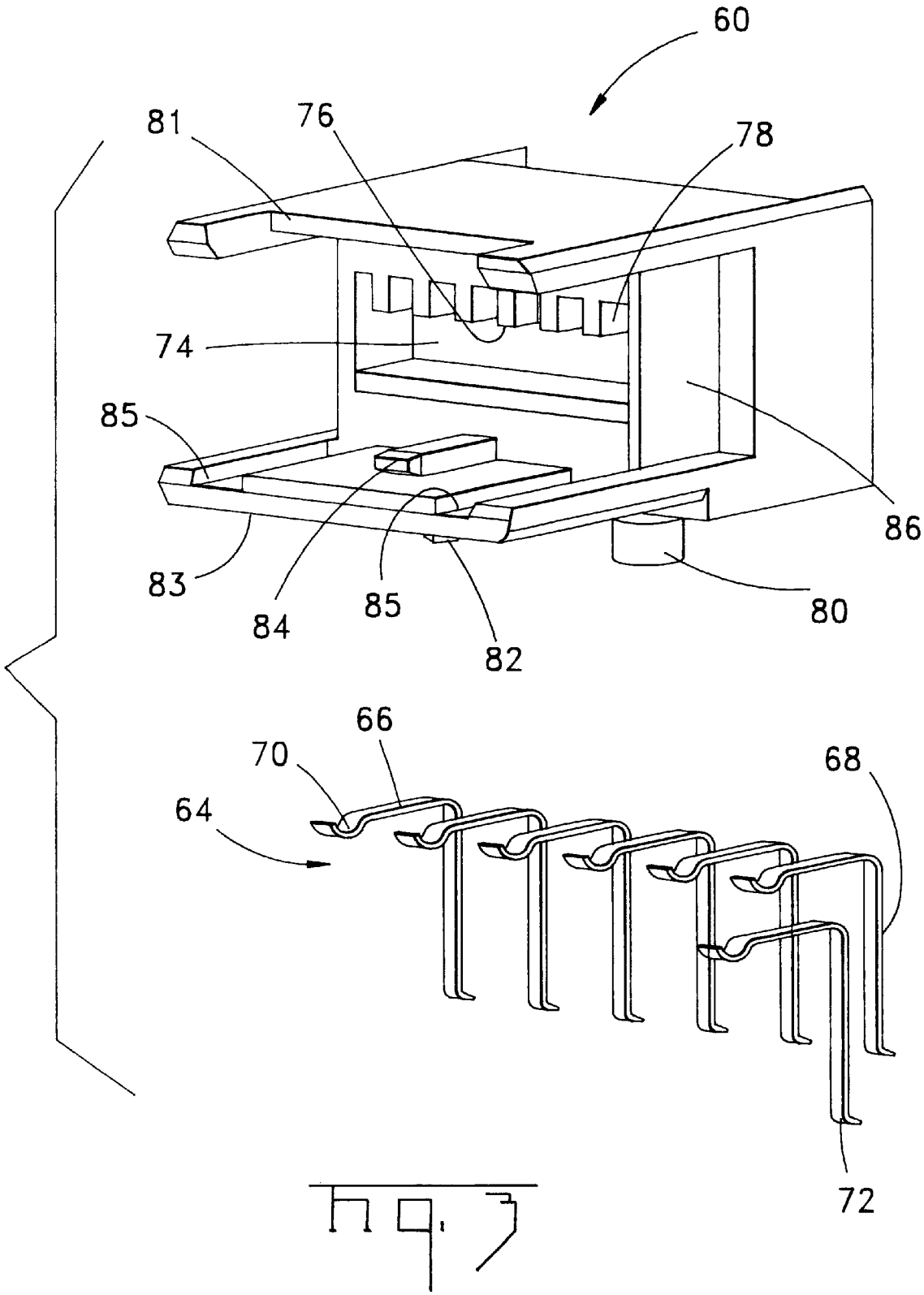
FIG. 7 illustrates a perspective view of a ferrule and strain relief mounted to a plug in accordance with a preferred embodiment of the present invention.

FIG. 1 illustrates a perspective view of a plug assembly 10 configured in accordance to one preferred embodiment of the present invention. The plug assembly 10 includes an upper shell 12 and a lower shell 14 enclosing a PC equalization board 16. The plug assembly 10 also includes a latch assembly 18 removably mounted to the upper and lower shells 12 and 14. The plug assembly 10 is securely mounted to the end of a cable 30 capable of transmitting high speed serial data, such as a quad cable and the like. A strain relief 20 is secured to the back end of the upper and lower shells 12 and 14 to protect the interconnection between the plug assembly 10 and the cable 30. The strain relief 20 includes multiple notches 22 cut therein to afford flexibility to the strain relief 20. The upper and lower shells 12 and 14 are formed through diecast molding of a conductive material, such as zinc, magnesium and the like. The latch assembly 18 is stamped and formed of phosphorous bronze, brass and the like.

FIG. 2 illustrates a perspective view of a socket or receptacle shield 50 formed in accordance with one preferred embodiment of the present invention. The receptacle shield 50 snappingly receives and is secured to the plug 10 to form a mating electrical connection therebetween. The receptacle shield 50 includes a top 52, sides 54 and bottom 56 forming four walls that define a front face 62 to receive the plug 10. A rear face 58 is closed with a back wall 57. The receptacle shield 50 may be formed of sheet material folded around an insulated housing 60 (FIG. 3).

FIG. 3 illustrates the insulated housing 60 and a plurality of contact fingers 64 to be mounted therein. Each contact finger 64 is formed in an L-shape with horizontal and vertical legs 66 and 68. The horizontal legs 66 include a spoon-shaped contact region 70 on an outer end, while vertical legs 68 include an elbow-shaped contact region 72 on the outer end. The spoon-shaped contact regions 70 frictionally engage contact pads 24 on the PC board 16. The elbow-shaped contact regions 72 are soldered to surface mount, contact pads on a motherboard (not shown), to which the receptacle shield 50 is securely mounted. The housing 60 includes a plug receiving opening 74 therein that accepts the front edge of the PC board 16. The opening 74 includes a plurality of projections 76 extending downward from an upper edge of the opening 74 to define recessed slots 78 therebetween. The slots 78 receive the horizontal legs 66 of the contact fingers 64. The housing 60 maintains the contact fingers 64 in a predetermined position and orientation by frictionally mounting the horizontal legs 66 of the contact fingers 64 in the slots 78 between the projections 76. The bottom of the housing 60 includes pins 80 and 82 that are received through holes in the receptacle shield 50 and motherboard to align, and secure in place, the housing 60. The housing 60 includes upper and lower ledges 81 and 83 projecting forward from a body. The lower ledge 83 includes grooves 85, and a polarizing key 84. The upper and lower ledges 81 and 83 cooperate to guide the plug 10 into the opening 74. Opposite sides of the housing 60 include recessed notches 86 to receive the guide wings 26 on the plug 10.

The receptacle shield 50 includes J-shaped grounding beams 90 formed integral with the bottom 56 and projecting forward, upward and into the front face 62. The grounding beams 90 are biased inward to contact the bottom surface of the lower shell 14 to form grounding connections between the bottom surface of the plug 10 and the receptacle shield 50. The sides 54 of the receptacle shield 50 include inwardly projecting contact guide wings 92 located near the rear end of the sides 54. The contact guide wings 92 include base sections punched out of sides 54. Outer ends of the guide wings 92 are bent to form ramped surfaces 94 projecting inward into the interior of the receptacle shield 50. The ramped surfaces 94 engage the guide wings 26 on either side of the plug 10 as the guide wings 26 enter notches 86 to form grounding connections therewith. The sides 54, top 52 and bottom 56 of the receptacle shield 50 further include chassis ground contacts 96, 98 and 99, respectively, that project outward. The chassis ground contacts 96, 98 and 99 form grounding connections with the metal chassis of the computer (not shown). The front edges of the sides 54 and top 52 include guide flanges 100 and 102, respectively, that are flared outward to form a lead-in area to guide the face of the plug 10 into the receptacle. The bottom 56 includes tabs 104 projecting downward to be received within the motherboard and securely soldered thereto. The back wall 57 includes tabs 106 projecting outward from either side thereof that are folded over and along the sides 56 to cover the seams formed between the back wall 57 and sides 54 when the walls of the receptacle are folded into a desired shape. The top 52 includes a hole 108 near the guide flange 102 to receive a locking member 139 on the plug 10.

Figure 6:
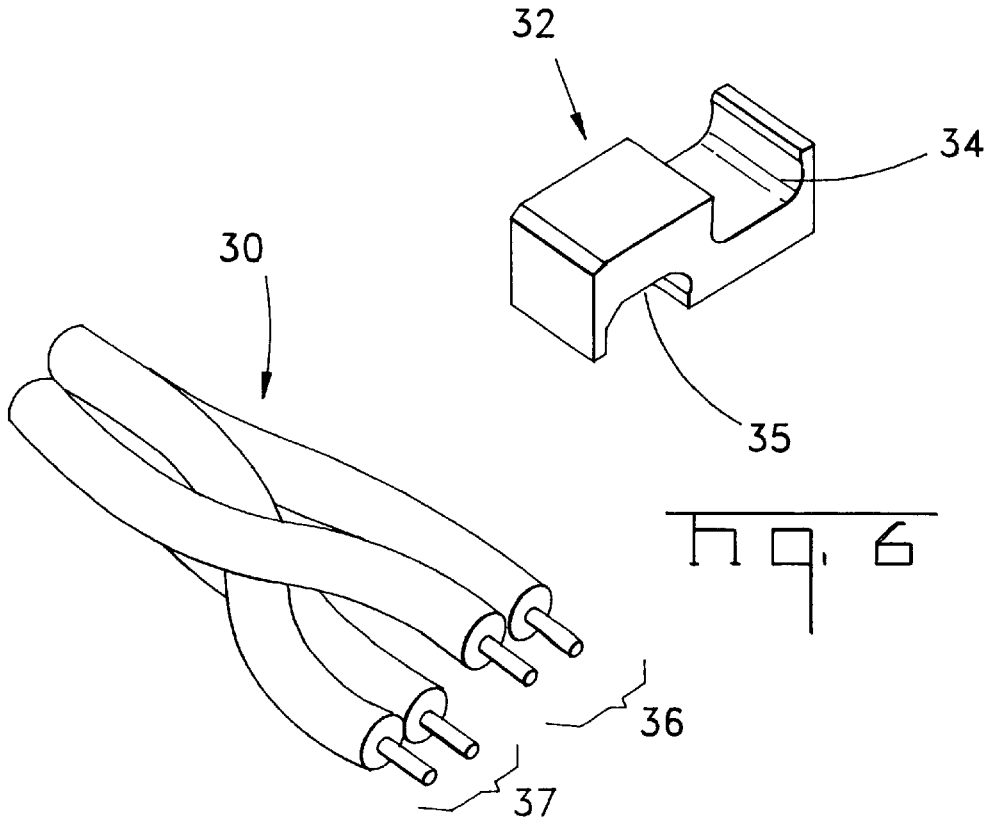
FIG. 6 illustrates a portion of a quad cable and wire organizer received within a plug in accordance with the preferred embodiment of the present invention.
Figure 7:
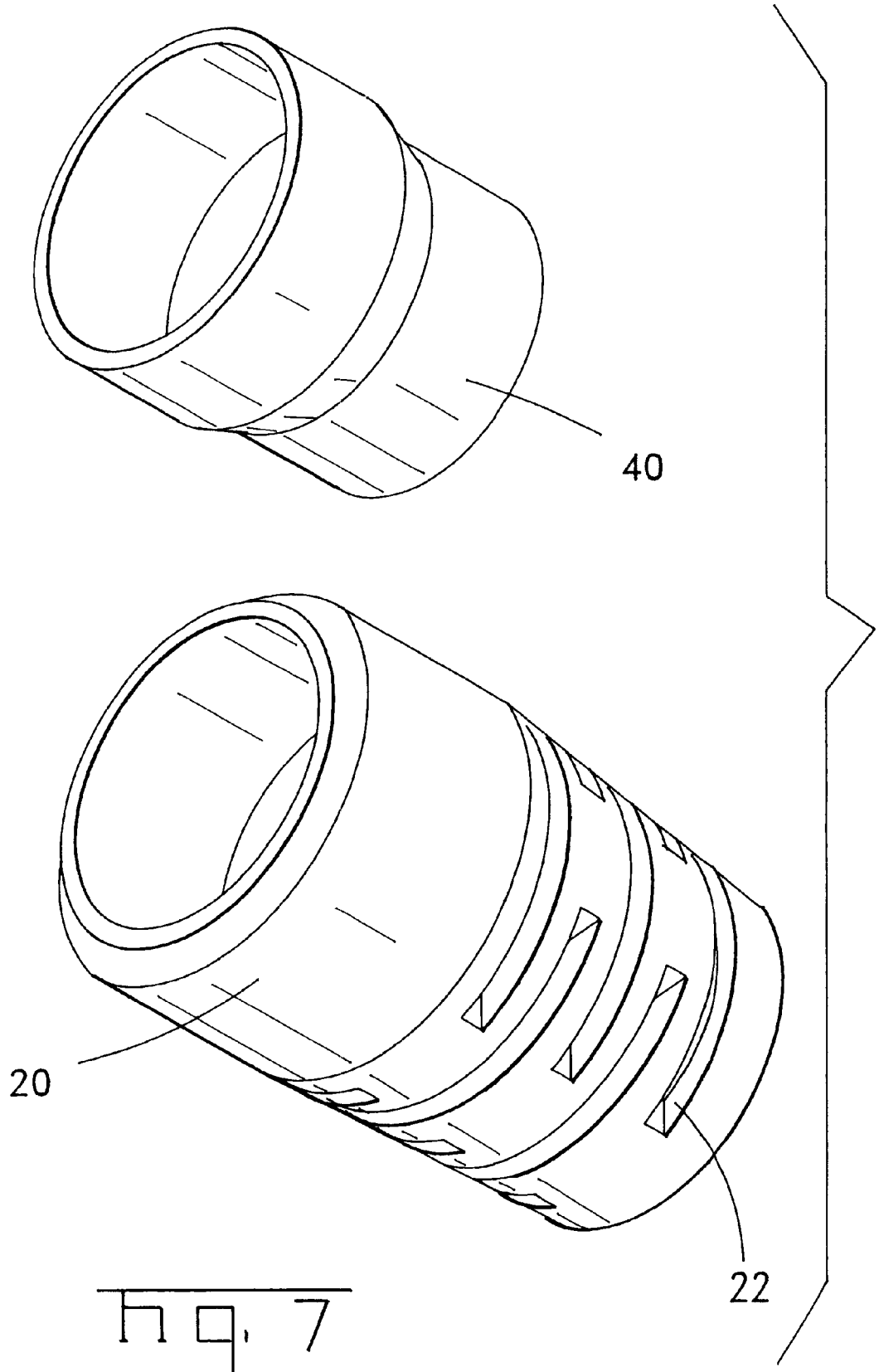

FIGS. 4–8 illustrate perspective views of the components forming the plug 10 and connecting the plug 10 to an end of a cable 30. The upper and lower shells 12 and 14 (FIG. 4) enclose the PC equalization board 16 (FIG. 8) and a wire organizer 32 (FIG. 6). The wire organizer 32 includes upper and lower recesses 34 and 35 which receive corresponding differential pairs 36 and 37, respectively, of transmit and receive insulated conductive lines. The wire organizer 32 maintains the differential pairs 36 and 37 in a desired arrangement with respect to one another to minimize interference and cross talk caused by high speed signals being carried through the cable 30 at the region within which the cable 30 presents signals onto the PC equalization board 16. The upper and lower shells 12 and 14 include upper and lower tubular sections 38 and 39 that combine to form a tubular opening through which the cable 30 enters the plug 10. The shield of the cable is received over the upper and lower tubular sections 38 and 39 and the ferrule is slid over the shield and crimped to secure the upper and lower shells 12 and 14 and shield to one another. The strain relief 20 is then placed over the ferrule 40 to provide additional support to the point of connection between the cable 30 and plug 10.

The plug 10 is described in more detail hereafter in connection with FIGS. 4 and 10–12. FIGS. 10–12 illustrate top, side and bottom views, respectively, of the plug 10. The upper shell 12 includes a top 120, sides 122, a front face 124 and a back wall 126 formed integrally with one another. The back wall 126 is also integrally formed with the upper tubular section 38 to form a unitary upper shell 12. The sides 122 include opposed knobs 128 projecting outward therefrom.

The latch assembly 18 (FIG. 5) includes a T-shaped principle section 132, integrally formed with side flanges 134, a front or facing plate 136 and a leading section 138. The front plate 136 includes a locking member 139 extending upward. The guide flange 102 contacts the locking member 139 and biases the front plate downward as the plug 10 is inserted into the receptacle shield 50. The locking member 139 latchably engages hole 108 (FIG. 13) in the top 52 of the receptacle shield 50 when the plug 10 is inserted in the receptacle shield 50. The side flanges 134 include holes 140 that are snapped over knobs 128 to secure the latch assembly 18 onto the upper shell 12. The side flanges 134 also include tabs 142 extending downward that are received within recesses 164 in either side 160 of the lower shell 14 when the upper and lower shells 12 and 14 are combined. The leading section 138 includes a hole 144 that receives a knob 146 projecting from the front face 124 of the upper shell 12. The front face 124 further includes pins 148 and a U-shaped recess 150. The U-shaped recess 150 receives a lower lip portion 152 of the leading section 138 of the latch assembly 18.

A travel limiting projection 130 extends upward from the top 120 and is located below the key-shaped principle section 132 proximate the intersection of the T-shaped principle section 132 and front plate 136. The projection 130 is spaced below the principle section 132 by a distance sufficient to permit the latch assembly 18 to bend downward when the plug 10 is moved into a mating connection with the receptacle shield 50. The projection 130 is constructed to limit the amount by which the latch assembly 18 is permitted to bend to prevent over straining the connection between the front plate 136 and principle section 132.

The lower shell 14 is constructed of a unitary diecast molded member including sides 160, bottom 161, a front face 162, and a rear wall 163. The rear wall 163 is formed integrally with the lower tubular section 39. The sides 160 include slotted recesses 164 that receive tabs 142 on the latch assembly 18 once assembled. The front edges of the sides 160 form the guide wings 26. The guide wings 26 are interconnected via a crossbar 166. The lower shell 14 further includes shelves 168 formed integrally upon the interior surface of the sides 160 to support the PC board 16. Keys 170 are also formed integrally with the sides 160 to properly orient and align the PC board 16. A skirt 172 is molded along the upper edge of the sides 160 to be received in a mating relation with the lower edges of the sides 122 of the upper shell 12. The skirts 172 form a sealed connection between the sides 160 and 122 of the upper and lower shells 12 and 14. The bottom 161 includes a slot 174 (FIG. 12) configured to receive a polarizing key 84 (FIG. 3) mounted on the top of the lower ledge 83 of the housing 60.

During construction, the latch assembly 18 is mounted upon the upper shell 12 by locating the knob 146 in the hole 144 and the lower lip 152 in the U-shaped recess 150. The side flanges 134 are snapped downward over the sides 122 until the holes 140 receive the knobs 128. Once the PC board 16, wire organizer 32 and cable 30 are properly mounted within the plug 10, the upper shell 12 and latch assembly 18 are combined with the lower shell 14. To mount the upper and lower shells 12 and 14 to one another, the front face 124 of the upper shell 12 is inserted with the pins 148 located below the crossbar 166. The upper shell 12 is then rotated downward until tabs 142 are received within recesses 164 and the lower edge of the sides 122 securely mates with the skirt 172 on the upper edge of the sides 160. Once the tabs 142 are received within recesses 164, the side flanges 134 are held firmly against the sides 122 of the upper shell 12, thereby retaining the knobs 128 securely within the holes 140. The shield of the cable is slid over the upper and lower tubular sections 38 and 39, the ferrule 40 is slid over the shield and crimped in a frictional manner. The strain relief 20 is then pulled up over the ferrule 40.

The latch assembly 18 securely locks the plug 10 within the receptacle shield 50, while the front plate 136 provides a grounding connection along a width of the front plate 136 between the top 120 and top 52. The width of the latch assembly 18 may be varied to provide adequate grounding characteristics for EMI shielding and to provide a desired biasing force upward against to top 52 of the receptacle shield 50. By way of example only, the front plate 136 may be as wide as the leading edge of the PC equalizer board 16.

Figure 8:
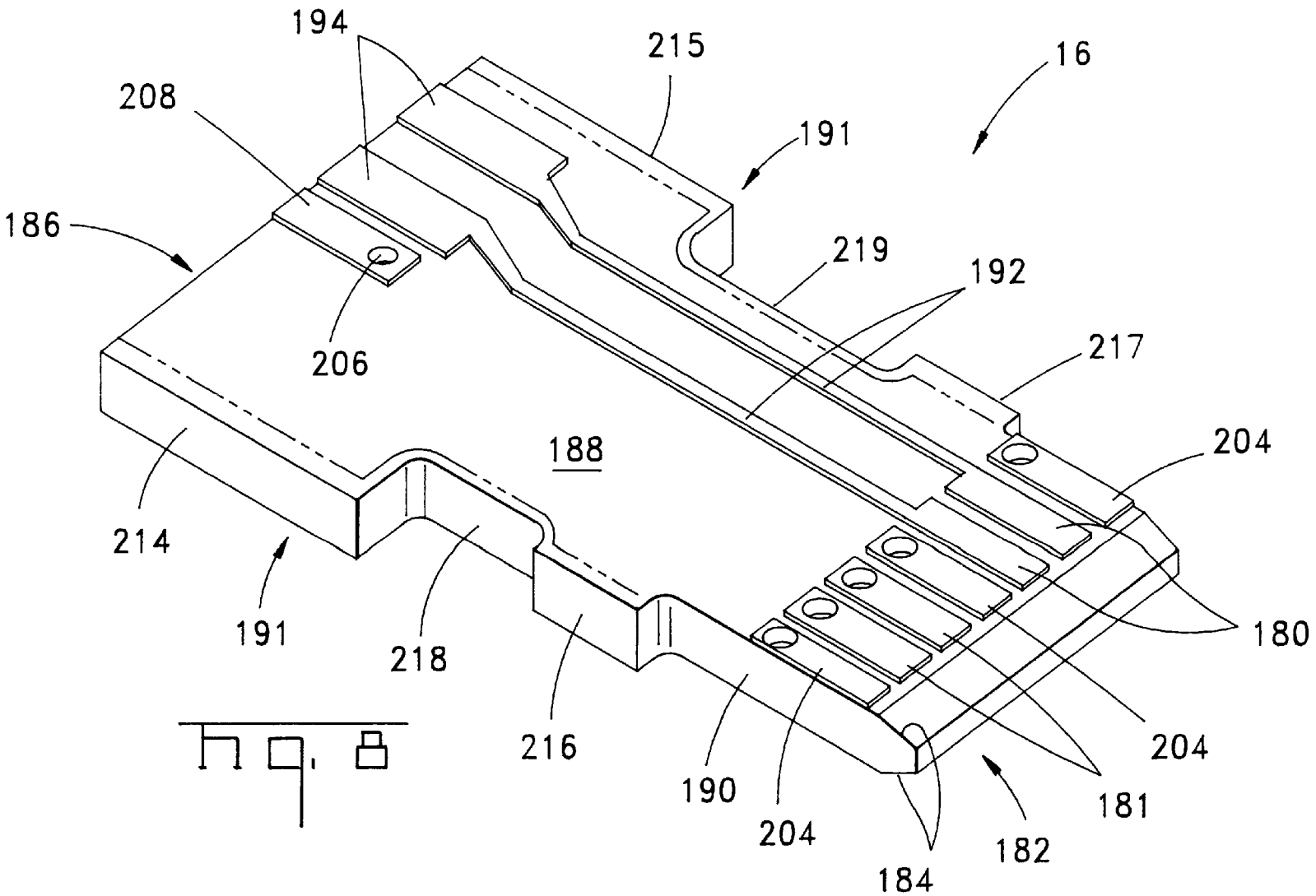
FIG. 8 illustrates a top perspective view of a PC equalizer board formed in accordance with a preferred embodiment of the present invention.
Figure 9:
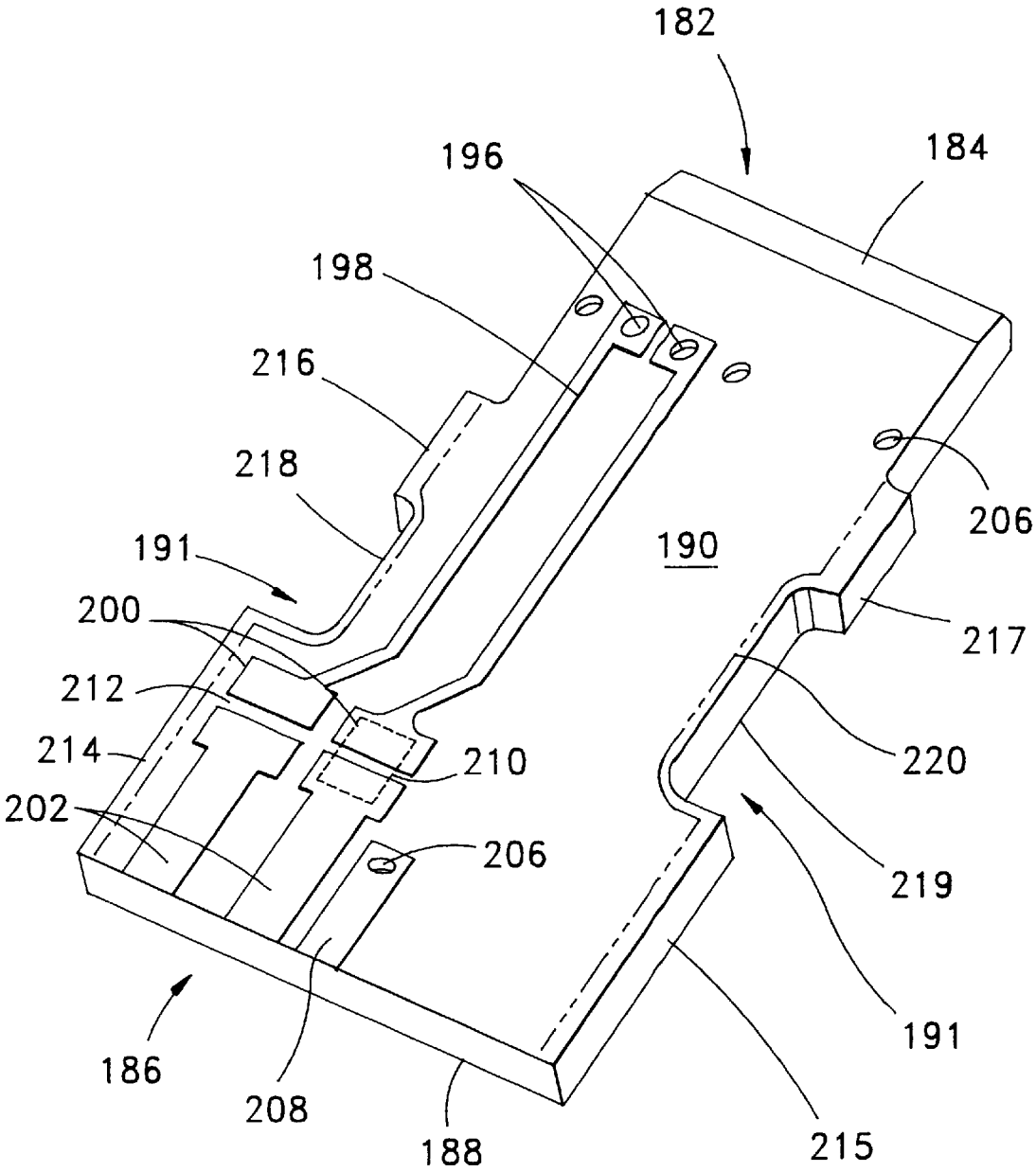
FIG. 9 illustrates a bottom perspective view of a PC equalizer board formed in accordance with a preferred embodiment of the present invention.

FIGS. 8 and 9 illustrate the PC equalization board 16 in accordance with at least one preferred embodiment of the present invention. The PC board 16 includes circuit components that perform signal conditioning upon high speed serial data received from cable 30. The PC board 16 includes front face 182, back end 186, top surface 188, bottom surface 190 and opposed side edges 191. The front face 182 includes chamfered edges 184 to facilitate insertion of the PC board 16 into the opening 74 of the housing 60. The top surface 188 includes multiple contact pads 180 and 181, and ground pads 204 aligned adjacent one another and located proximate the front face 182. The contact pads 180, 181 and ground pads 204 electrically and frictionally engage the spoon-shaped contact regions 70 upon contact fingers 64.

In the example of FIGS. 8 and 9, the contact pads 180 on the top surface 188 correspond to a differential pair of either transmit or receive insulated conductors. The differential pair of contact pads 180 are connected to a differential pair of solder pads 194 via linear electrical traces 192. The differential pair of solder pads 194 are connected to a corresponding differential pair 36 of the cable 30 via a soldering connection. A second differential pair of contact pads 181 are connected through vias 196 to linear traces 198 (FIG. 9) on the bottom surface 190 of the PC board 16. The linear traces 198 expand at the rear end to form equalizing component receiving regions 200 (FIG. 8). The bottom surface 190 of the PC board 16 also includes a differential pair of solder pads 202 adapted to be electrically connected to differential pair 37 of the cable 30. The solder pads 202 and regions 200 are separated by non-conductive gaps 212.

The solder pads. 202 and component receiving regions 200 are spaced apart from one another and configured to receive electrical equalization components 210 spanning the gap 212 therebetween. The equalization components 210 may be varied to afford different desired electrical characteristics to the PC board 16. For instance, the components 210 may comprise one resistor and one capacitor, the values for which are based upon various signal characteristics of the cable 30. By way of example only, a cable 30 having an impedance of 100 ohms is operated with a first PC board 16 having one combination of values for components 210, while a cable 30 having an impedance of 150 ohms is operable with a different PC board 16 having a separate combination of values for components 210.

The PC board 16 includes an internal grounding plane extending from the back end 186 to the front face 182 and entirely enclosed within the PC board 16. An edge of the grounding plane is designated by reference numeral 220. Grounding pads 204 are provided on the top surface 188 proximate the front face 182. The ground pads 204 are connected to a grounding plane imbedded within and extending along the length of the PC board 16. The ground pads 204 are connected to the grounding plane through ground vias 206. Ground solder pads 208 are provided on the top and bottom surfaces 188 and 190 of the PC board 16. The ground soldering pads 208 are connected to the grounding plane through ground vias 206. The grounding plane 220 enables interconnection of grounding pads 204 and grounding solder pads 208. Interconnects 196 do not electrically communicate with the grounding plane 220.

The configuration of contact pads 180, 181, and ground pads 204 along the top surface 188 may be varied, provided that the configuration of contact and grounding pads does not afford undue reflection, signal interference or cross talk. According to at least one preferred embodiment of the present invention, the contact pads 180, 181 and ground pads 204 are arranged to include ground pads 204 proximate opposite sides 191 while contact pads 181 and contact pads 180 are separated by a third grounding pad 204. Hence, the contact and ground pad configuration includes one ground pad, two contact pads, one ground pad, two contact pads, and one ground pad. Adjacent contact pads in the preferred embodiment of FIGS. 8 and 9 include contact pads adjacent one another that are associated with a single differential pair to minimize cross talk.

Figure 4:
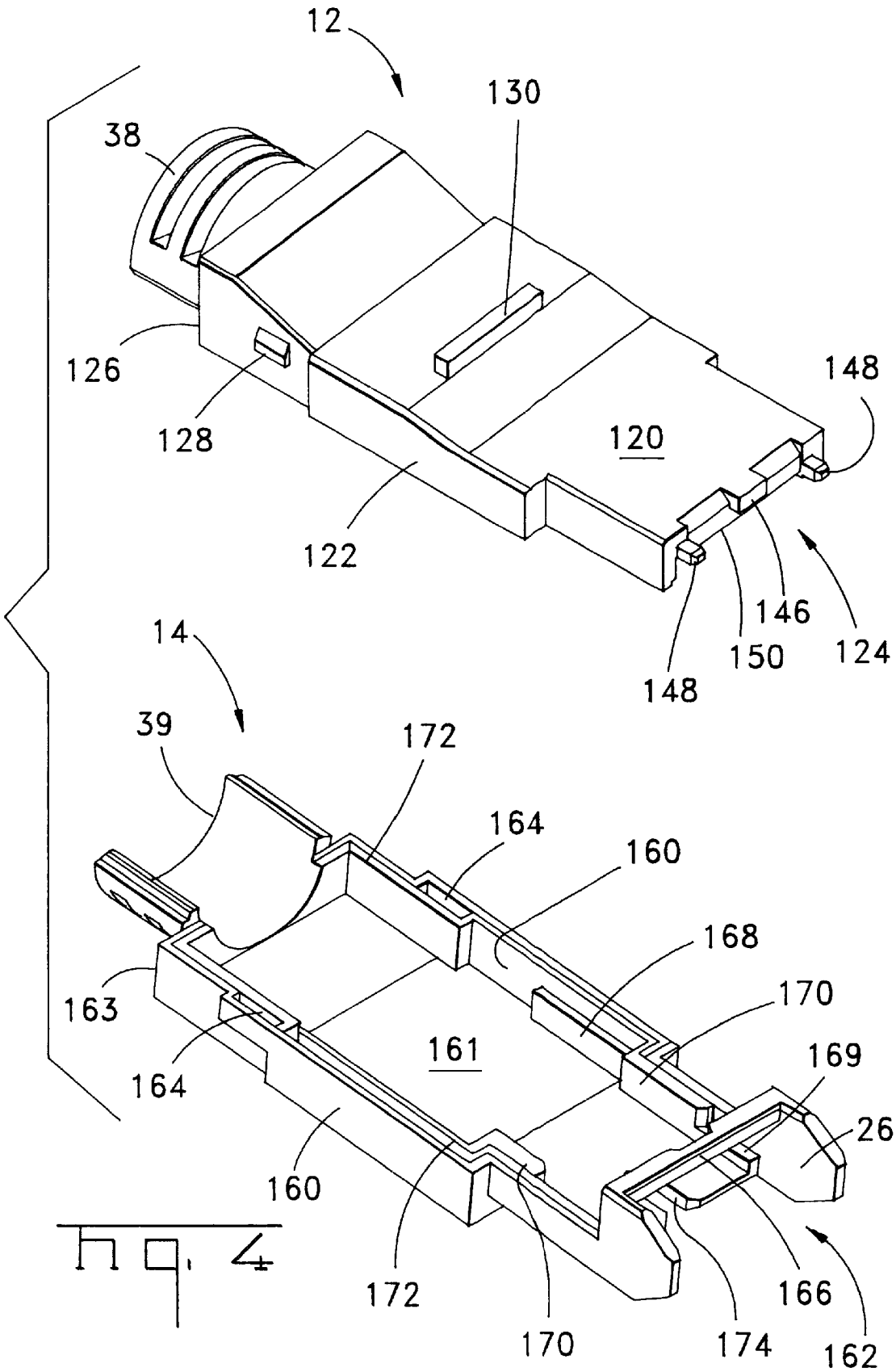
FIG. 4 illustrates a perspective view of upper and lower shells included within a plug formed in accordance with a preferred embodiment of the present invention.
Figure 5:
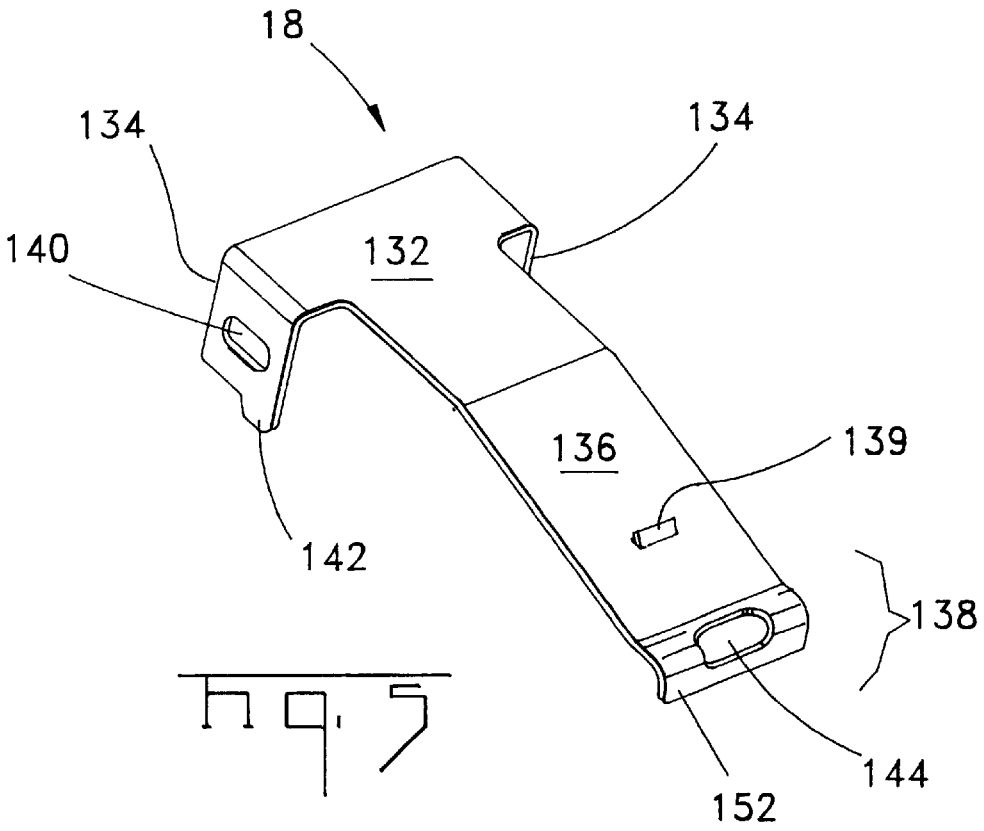
FIG. 5 illustrates a perspective view of a latch assembly mounted to the upper and lower shells in accordance with a preferred embodiment of the present invention.

The PC board 16 includes a configuration of keying projections 214–217 and notches 218–219 configured to fit between keys 170 and sides 160 of the lower shell 14. The keying projections 214–217, notches 218–219 and keys 170 cooperate to insure that the PC board 16 is placed with the top surface 188 pointed upward and is located at a desired longitudinal and vertical position within the plug 10. The keys 170 are received by notches 218–219, while the keying projections 214 and 215 rest upon shelves 168 (FIG. 4). The projections 216 and 217 rest upon shelves 169.

Figure 13:
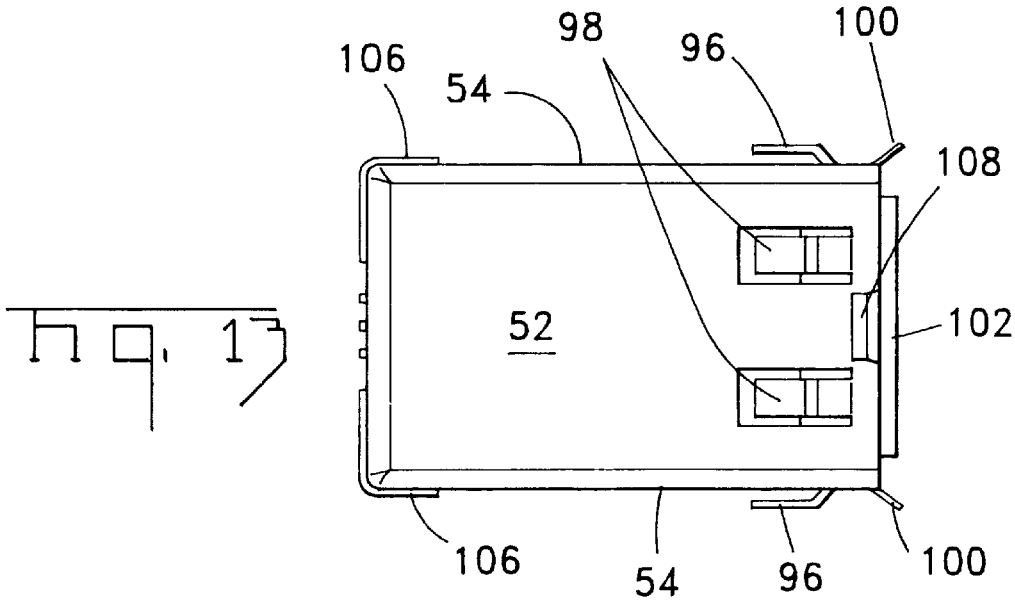
FIG. 13 is a top plan view of a receptacle formed in accordance with a preferred embodiment of the present invention.
Figure 14:
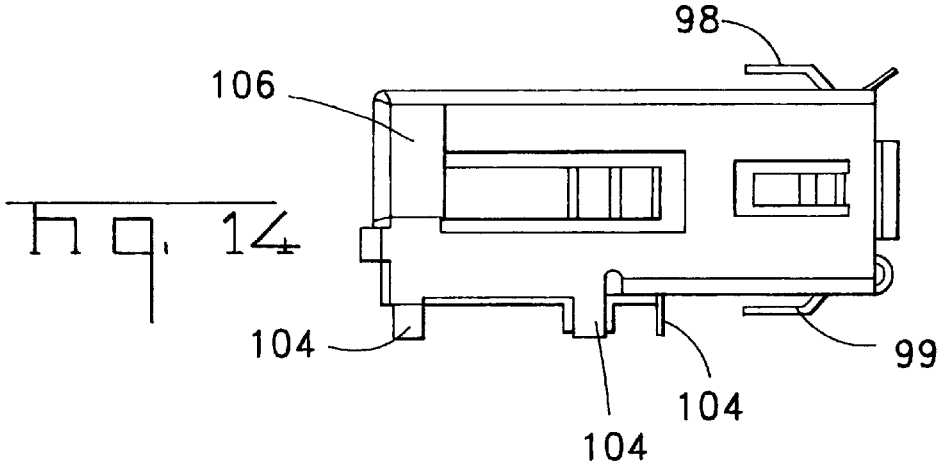
FIG. 14 is a side plan view of a receptacle formed in accordance with a preferred embodiment of the present invention.

FIGS. 13–16 illustrate top, side, bottom and front views, respectively, of the receptacle shield 50. FIG. 13 illustrates the top 52 including ground contacts 98 to afford grounding connections with the chassis. Grounding contacts 96 project outward from the sides 54 to also provide grounding contacts with the chassis. FIG. 13 also provides a clear view of the guide flanges 100 and 102. FIG. 14 illustrates a plurality of tabs 104 extending downward from the bottom of the receptacle shield 50 that are received in the motherboard and soldered thereto.

Figure 15:
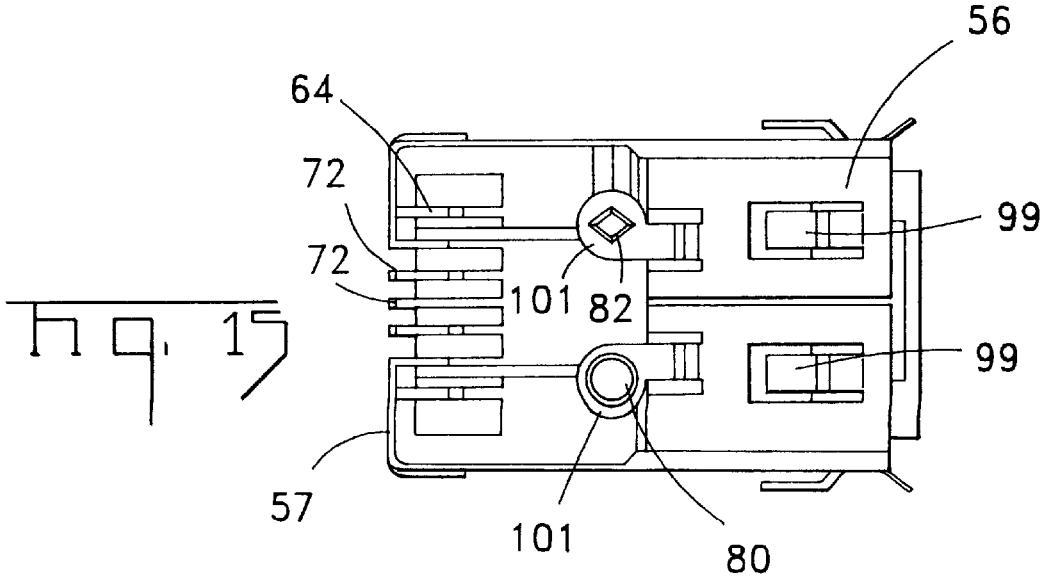
FIG. 15 is a bottom plan view of a receptacle formed in accordance with a preferred embodiment of the present invention.

FIG. 15 illustrates the bottom 56 in more detail including ground contacts 99 and standoffs 101. The pins 80 and 82 are formed integral with the standoffs 101. The pins 80 and 82 also are inserted through holes in the motherboard. Optionally, pin 82 may be constructed with a diamond cross-section to permit easier installation on the motherboard, while maintaining proper alignment. The bottom 56 receives the contact regions 72 of the contact fingers 64 near the back 57. The contact regions 72 are surface mounted upon contacts on the motherboard in order to provide electrical connections between the motherboard and the differential pairs of cable 30 via the PC board 16, contact fingers 64.

FIG. 16 illustrates a front view of the receptacle shield 50 showing grounding beams 90, polarizing key 84, opening 70 and projections 76.

During construction, the housing 60 is inserted within the receptacle shield 50 and mounted on the motherboard. The plug 10 is assembled as explained above and mounted to the end of a cable 30, such as a quad cable capable of carrying high speed serial data. The plug 10 is connected to the receptacle shield 50 by inserting the front face 182 of the PC board 16 into the opening 74 until contacts 180, 181 and 204 engage contact fingers 64. The locking member 139 engages the hole 108 in the top 52 of the receptacle shield 50 in order to maintain the plug 10 within the receptacle shield 50. The biasing forces applied by the latch assembly 18 maintain the locking member 139 within the hole 108. The latch assembly 18 maintains a grounding connection between the top 120 of the plug 10 and the top 52 of the receptacle shield 50. Contact guide wings 92 maintain a grounding connection between the guide wings 26 of the plug 10 and the sides 54 of the receptacle shield 50. Grounding beams 90 maintain grounding connections between the bottom 161 of the plug 10 and the bottom 56 of the receptacle shield 50. Contact guide wings 92 enable the width of the receptacle to be minimized. Optionally, the grounding beams 90 may be removed and contact guide wings (such as guide wings 92) may be provided in the bottom 56 of the receptacle shield 50 in order to further reduce the height of the receptacle shield 50. Contact guide wings 92 afford a lesser profile than needed for grounding beams 90. Thus, receptacles using grounding beams along either side of the receptacle would require a wider receptacle. Contact guide wings 92 reduce the overall width of the receptacle. The receptacle shield 50 is substantially void of any specific structure in the top 52 for providing a grounding contact with the plug 10. Instead, the latch assembly 18 is constructed in a manner that performs the dual functions of locking the plug and receptacle together, while simultaneously affording a grounding connection between the top of the plug and the surface of the top 52 of the receptacle shield 50. In the foregoing manner, the latch assembly 18 reduces the complexity of the receptacle shield 50 and the height of the receptacle.

The upper and lower shells 12 and 14 of the plug 10 are substantially void of any openings in the bottom 161, sides 160 and 122, and top 120, thereby affording EMI shielding characteristics without the need for additional shielding structure therearound. The upper and lower shells 12 and 14 are formed of diecast molded conductive material, thereby affording the ability to include integral features (e.g., shelves 168, keys 170, recesses 164) without forming holes in the shells or adding separate components thereto.

In accordance with at least one alternative embodiment, the contour of the PC board 16 is configured to be loosely received within the lower shell 14. The sides 191 of the PC board 16 are permitted to float laterally, from side to side between the sides 161 of the lower shell 14. The lateral float between the sides 191 and 161 permits the face 182 to be properly guided into the opening 74 in the holder 60.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector comprising:

a conductive receptacle assembly having walls defining a connector opening, at least one wall including grounding contacts;

a conductive plug member for connection to the receptacle assembly in the opening, the plug member having peripheral surfaces electrically engaging the grounding contacts; and a latch assembly mounted to the plug member, the latch assembly having a spring-bias facing plate lockably engaging one wall of the receptacle assembly, the latch assembly has a T-shaped body integrally formed with side flanges, a leading section and the facing plate, the side flanges and the leading section have holes to snapably engage projections from the plug member, the holes and the projections securing the latch assembly to the plug member, the latch assembly being conductive to maintain a grounding connection between said plug member and said one wall of the receptacle assembly, while the grounding contacts maintain grounding connections between said plug member and a remainder of the walls of the receptacle assembly.

2. The electrical connector of claim 1, wherein said latch assembly comprises a principal body extending laterally and formed integral with side flanges, and extending longitudinally and formed integral with the facing plate.

3. The electrical connector of claim 1, wherein the latch assembly and grounding contacts cooperate to provide grounding connections between each side of the plug member and receptacle assembly.

4. The electrical connector of claim 1, further comprising multiple J-shaped ground beams provided along one wall of the receptacle assembly and forward, upward and back into the receptacle to form grounding connections with the plug member.

5. The electrical connector of claim 1, wherein the latch assembly includes a leading section having a lower lip portion received within a U-shaped recess in a front face of the plug member, said leading section being sandwiched between front faces of upper and lower shells in the plug member.

6. The electrical connector of claim 1, wherein the latch assembly and grounding contacts cooperate to provide grounding connections between each side of the plug member and receptacle assembly.

7. The electrical connector of claim 1, further comprising multiple J-shaped ground beams provided along one wall of the receptacle assembly and forward, upward and back into the receptacle assembly to form grounding connections with the plug member.

8. An electrical connector comprising:

a conductive receptacle assembly having walls defining a connector opening, at least one wall including grounding contacts;

a conductive plug member for connection to the receptacle assembly in the opening, the plug member having peripheral surfaces electrically engaging the grounding contacts; and a latch assembly mounted to the plug member, the latch assembly having a spring-bias facing plate lockably engaging one wall of the receptacle assembly, the latch assembly includes a leading section having a lip portion received within a U-shaped recess in a front face of the plug member, the leading section being sandwiched between front faces of upper and lower shells in the plug member, the latch assembly being conductive to maintain a grounding connection between said plug member and said one wall of the receptacle assembly, while the grounding contacts maintain grounding connections between said plug member and a remainder of the walls of the receptacle assembly.

9. The electrical connector of claim 8, wherein said latch assembly comprises a principal body extending laterally and formed integral with side flanges, and extending longitudinally and formed integral with the facing plate.

10. The electrical connector of claim 8, wherein said latch assembly comprises a locking projection formed on the facing plate and arranged to align with a hole in the receptacle assembly, the facing plate remaining biased against the receptacle assembly to maintain the grounding connection.

* * * * *